US006215398B1

(12) United States Patent
Platner et al.

(10) Patent No.: US 6,215,398 B1
(45) Date of Patent: Apr. 10, 2001

(54) OCCUPANCY SENSORS FOR LONG-RANGE SENSING WITHIN A NARROW FIELD OF VIEW

(75) Inventors: Brian P. Platner, 100 Trailwood Dr., Guilford, CT (US) 06437; Philip H. Mudge, Brookfield, CT (US); William J. Fassbender, Watertown, CT (US); Keith K. Platner, Northford, CT (US)

(73) Assignee: Brian P. Platner, Guilford, CT (US)

( * ) Notice: Subject to any disclaimer, the term of this patent is extended or adjusted under 35 U.S.C. 154(b) by 0 days.

(21) Appl. No.: 09/212,738

(22) Filed: Dec. 15, 1998

Related U.S. Application Data

(60) Provisional application No. 60/068,012, filed on Dec. 18, 1997.

(51) Int. Cl.[7] ..... G08B 13/18

(52) U.S. Cl. ..... 340/556; 340/567; 250/342; 250/DIG. 1

(58) Field of Search ..... 340/555, 556, 340/557, 309.15, 693.5, 693.6, 693.9, 693.11, 567, 565; 250/221, 342, DIG. 1; 307/116, 117; 315/150, 155, 158, 159

(56) References Cited

U.S. PATENT DOCUMENTS

| | | | | |
|---|---|---|---|---|
| 3,699,382 | * | 10/1972 | Franke | 315/92 |
| 3,936,822 | | 2/1976 | Hirschberg | 340/522 |
| 4,060,123 | | 11/1977 | Hoffman et al. | 165/11.1 |
| 4,169,982 | | 10/1979 | Rittmann | 307/116 |
| 4,223,831 | | 9/1980 | Szarka | 236/47 |
| 4,321,594 | * | 3/1982 | Galvin et al. | 340/567 |
| 4,340,826 | | 7/1982 | Muchnick | 307/157 |
| 4,346,427 | | 8/1982 | Blissett et al. | 340/600 X |
| 4,365,167 | | 12/1982 | Weimer et al. | 307/66 |
| 4,451,734 | * | 5/1984 | St. Jean et al. | 250/342 |
| 4,527,216 | | 7/1985 | Stammely | 361/156 |
| 4,618,770 | | 10/1986 | Maile | 340/567 X |
| 4,630,684 | | 12/1986 | Cinzori et al. | 340/522 X |
| 4,703,171 | | 10/1987 | Kahl et al. | 340/567 X |
| 4,746,906 | | 5/1988 | Lederer | 340/522 |
| 4,772,875 | | 9/1988 | Maddox et al. | 340/522 |
| 4,825,079 | | 4/1989 | Takamatsu et al. | 250/342 X |
| 4,864,278 | * | 9/1989 | Wiley | 340/555 |
| 4,868,391 | * | 9/1989 | Messiou | 250/353 |
| 4,874,962 | | 10/1989 | Hermans | 307/116 |
| 4,890,093 | | 12/1989 | Allison et al. | 340/567 |
| 4,975,584 | | 12/1990 | Benjamin et al. | 340/600 X |
| 5,015,994 | | 5/1991 | Hoberman et al. | 340/567 |
| 5,023,593 | | 6/1991 | Brox | 340/522 |
| 5,128,654 | | 7/1992 | Griffin et al. | 340/567 |
| 5,142,199 | | 8/1992 | Elwell | 340/567 X |

(List continued on next page.)

OTHER PUBLICATIONS

"CX–100 Passive Infrared Sensor" (data sheet), Publication No. 6301, published by The Watt Stopper®, Inc., of Santa Clara, California (undated).

*Primary Examiner*—Thomas Mullen
(74) *Attorney, Agent, or Firm*—Fish & Neave; Gerry J. Tuma

(57) ABSTRACT

Occupancy sensors are presented that include a flat lens for focusing detecting beams into narrower, longer range beams than those of conventional curved lenses. A sensing circuit generates a detecting beam that is substantially perpendicular to the flat lens. The flat lens has a plurality of lens segments that provide long, intermediate, and short range sensing beams. To facilitate positioning of an occupancy sensor, the sensor includes a plurality of indicators that indicate the sensor's long and short range sensing limits. An override timer circuit is provided that upon activation sets the occupancy sensor in occupancy mode for a predetermined time period. A warm-up timer circuit is also provided that upon power-up automatically sets the occupancy sensor in occupancy mode for a predetermined warm-up period. These occupancy sensors are well-suited for environments with long aisles, high ceilings, and high intensity discharge lighting.

24 Claims, 10 Drawing Sheets

U.S. PATENT DOCUMENTS

| | | | | |
|---|---|---|---|---|
| 5,151,840 | | 9/1992 | Siefken | 361/13 |
| 5,153,560 | | 10/1992 | Ichikawa | 340/522 |
| 5,155,474 | * | 10/1992 | Park et al. | 340/567 X |
| 5,189,393 | | 2/1993 | Hu | 340/522 |
| 5,266,807 | | 11/1993 | Neiger | 340/567 X |
| 5,276,427 | | 1/1994 | Peterson | 340/522 |
| 5,307,051 | | 4/1994 | Sedlmayr | 340/573.1 |
| 5,311,024 | * | 5/1994 | Marman et al. | 250/353 |
| 5,381,323 | * | 1/1995 | Osteen et al. | 340/567 X |
| 5,386,210 | | 1/1995 | Lee | 340/567 |
| 5,406,073 | * | 4/1995 | Sharp et al. | 250/221 |
| 5,424,717 | * | 6/1995 | Platt et al. | 340/557 |
| 5,428,345 | | 6/1995 | Bruno | 340/541 |
| 5,442,532 | * | 8/1995 | Boulos et al. | 340/567 X |
| 5,534,850 | | 7/1996 | Lee | 340/565 |
| 5,662,411 | * | 9/1997 | Haslam et al. | 340/567 X |
| 5,701,117 | | 12/1997 | Platner et al. | 340/567 |
| B1 4,874,962 | | 4/1995 | Hermans | 307/116 |

* cited by examiner

OCCUPANCY SENSORS FOR LONG-RANGE SENSING WITHIN A NARROW FIELD OF VIEW

CROSS REFERENCE TO RELATED APPLICATION

This claims the benefit of United States Provisional Application Ser. No. 60/068,012, filed Dec. 18, 1997.

BACKGROUND OF THE INVENTION

This invention relates to occupancy sensors. More particularly, this invention relates to occupancy sensors that provide long-range occupancy sensing within a narrow field of view.

Occupancy sensors typically sense the presence of one or more persons within a designated area and generate occupancy signals indicative of that presence. These signals activate or deactivate one or more electrical appliances, such as, for example, a lighting unit or a heating, ventilating, and air conditioning system. Occupancy sensors help reduce maintenance and electrical energy costs by indicating when these appliances can be turned off.

Conventional occupancy sensors sense occupancy by projecting a detecting beam, (active sensing) or defining a detection zone (passive sensing), through a curved lens that provides the sensor with a wide field of view. This field of view typically ranges from about 160° for wall-mounted sensors to about 360° for ceiling-mounting sensors. Occupancy os sensed, for example, when the the heat differential between the background heat of the designated area and that of a person entering the area is sensed.

Such conventional occupancy sensors, however, are typically inefficient when used in environments requiring long-range, narrow field of view sensing, such as in warehouse environments. Warehouse environments typically have long aisles between high storage areas. Accordingly, much of the energy used to generate detecting beams or define detection zones in wide fields of view is wasted, rendering conventional sensors inefficient. Moreover, the curved lenses used to provide the wide fields of view limit the sensing range of conventional sensors. Thus, each aisle may typically require several conventional occupancy sensors to provide adequate coverage. This alone may render conventional occupancy sensors impractical in large warehouse environments having hundreds of thousands of square feet.

Furthermore, warehouse environments typically have high ceilings (e.g., 30 feet). To provide the proper angles for optimum sensing performance, occupancy sensors should preferably be mounted on walls near the top. Scissor lifts are usually required to install occupancy sensors at that height. The occupancy sensors are thus not easily accessible. Adjustments and final alignments can therefore be very difficult and time consuming. For example, it is often difficult to determine if a conventional sensor is positioned properly for sensing occupancy down a long aisle. The light emitting diode commonly used in conventional sensors to signal occupancy cannot normally be seen when attempting to locate the long-range sensing limit of the sensor.

Warehouse environments frequently contain dust and other airborne particles that can adversely affect the operation of conventional occupancy sensors, which generally are not adequately protected from such conditions. The large curved lens areas of conventional sensors require regular periodic cleaning, and the sensor electronics often become contaminated requiring cleaning or replacement. Conventional occupancy sensors are thus subject to increased maintenance, which is made more difficult because of their high mount location.

Also, warehouse environments commonly use high intensity discharge (HID) lighting. This type of lighting typically operates at two settings: high intensity and low intensity. When power is first applied, HID lamps usually require a warm-up period at high intensity of about 15 to 20 minutes. Thus, these lamps are not regularly turned off. When used with occupancy sensors, an HID lamp operates at high intensity when a signal indicating occupancy is received and at low intensity when a signal indicating non-occupancy is received. Furthermore, when HID lamps are first installed, they require operation at high intensity for about 100 hours or more (i.e., a burn-in period) in order to reach their true color rendition. Conventional occupancy sensors are not well-suited for HID lighting.

Conventional occupancy sensors typically do not automatically operate in occupancy mode (i.e., the sensor outputs a signal indicating occupancy) for a fixed period of time when the sensor first powers-up. Some occupancy sensors do however have a manual override switch that sets the sensor in occupancy mode. Thus, to operate HID lamps at high intensity for the warm-up period when first powered-up, conventional occupancy sensors have to be manually set in occupancy mode for the warm-up period, and then manually reset to normal operation. In a warehouse environment with hundreds or thousands of HID lamps, such a manual effort is impractical at best and prohibitively time consuming and costly at worst.

Similarly, to provide a burn-in period for newly installed HID lamps, conventional occupancy sensors should also be manually set to occupancy mode, and then manually reset to normal operation after the burn-in period. Again, such a manual effort is impractical at best and prohibitively time consuming and costly at worst.

In view of the foregoing, it would be desirable to provide an occupancy sensor that provides more efficient long-range occupancy sensing within a narrow field of view.

It would also be desirable to provide an occupancy sensor that can be easily adjusted and aligned to sense occupancy within a designated area.

It would further be desirable to provide an occupancy sensor that can be set in occupancy mode for a predetermined time period, after which the sensor automatically returns to normal operation.

It would still further be desirable to provide an occupancy sensor that upon power-up automatically operates in occupancy mode for a predetermined warm-up period, after which the sensor automatically returns to normal operation.

SUMMARY OF THE INVENTION

It is an object of this invention to provide an occupancy sensor that provides more efficient long-range occupancy sensing within a narrow field of view.

It is also an object of this invention to provide an occupancy sensor that can be easily adjusted and aligned to sense occupancy within a designated area.

It is a further object of this invention to provide an occupancy sensor that can be set in occupancy mode for a predetermined time period, after which the sensor automatically returns to normal operation.

It is still a further object of this invention to provide an occupancy sensor that upon power-up automatically operates in occupancy mode for a predetermined warm-up period, after which the sensor automatically returns to normal operation.

In accordance with this invention, an occupancy sensor for more efficient long-range sensing within a narrow field of view is provided. The occupancy sensor includes sensor circuitry operable to sense occupancy and generate occupancy signals, a voltage input terminal coupled to the sensor circuitry for receiving an input voltage, and an output terminal coupled to the sensor circuitry for outputting occupancy signals. The output terminal preferably includes a relay contact. The sensor circuitry includes a sensing circuit that generates a detecting beam. Alternatively, the sensing circuit passively defines a detection zone (accordingly, "detecting beam" alternatively means "detection zone"). The occupancy sensor also includes a rigid housing disposed about the sensor circuitry, the rigid housing having an opening over the sensing circuit. A flat lens is mounted on the rigid housing over the opening. The sensing circuit is positioned such that the detecting beam is substantially perpendicular to the flat lens. The occupancy sensor provides long-range sensing up to preferably about 100 feet within a field of view ranging from preferably about 15° to preferably about 25°.

The flat lens is preferably a Fresnel lens, and preferably has a plurality of lens segments that enable the flat lens to provide the occupancy sensor with long, intermediate, and short range occupancy sensing.

To facilitate positioning of the sensor, the occupancy sensor preferably includes a plurality of indicators that indicate when occupancy is sensed. One indicator preferably indicates when long-range occupancy is sensed, and another preferably indicates when short range occupancy is sensed. The indicators preferably include light emitting diodes (LEDs) that illuminate and are visible through the flat lens when occupancy is sensed. One LED appears to illuminate more brightly than the other LEDs when viewed from within a long-range field of view, and another LED appears to illuminate more brightly than the other LEDs when viewed from within a short-range field of view.

The sensor circuitry preferably includes an override timer circuit that when activated causes the sensor circuitry to output an occupancy signal indicating occupancy for a predetermined time period. The predetermined time period is adjustable. For example, the predetermined time period can be set to about 100 hours. The occupancy sensor automatically returns to normal operation substantially upon elapse of the predetermined time period.

The sensor circuitry also preferably includes a warm-up timer circuit that causes the sensor circuitry to output an occupancy signal indicating occupancy for a predetermined warm-up period when power is initially applied to the occupancy sensor. The predetermined warm-up period is adjustable. The occupancy sensor automatically returns to normal operation substantially upon elapse of the predetermined warm-up period.

The rigid housing of the occupancy sensor preferably includes an access door that permits access to adjustment controls when open and protects the controls and sensor circuitry from airborne particles when closed. The access door remains attached to the rigid housing when the door is open to prevent loss of the door while sensor adjustments are being made.

The present invention also includes an occupancy sensor system. The occupancy sensor system includes an occupancy sensor having a flat lens, and mounting hardware attached to the sensor. The mounting hardware permits the sensor to be positioned after the hardware is mounted to a structure, such as a wall or ceiling, such that the sensing range and field of view of the sensor can be aligned in accordance with a designated area.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The present invention provides occupancy sensors that more efficiently sense long-range occupancy within a narrow field of view. The present invention is well-suited for environments with long aisles, high ceilings, and high intensity discharge lighting.

Figure 1:
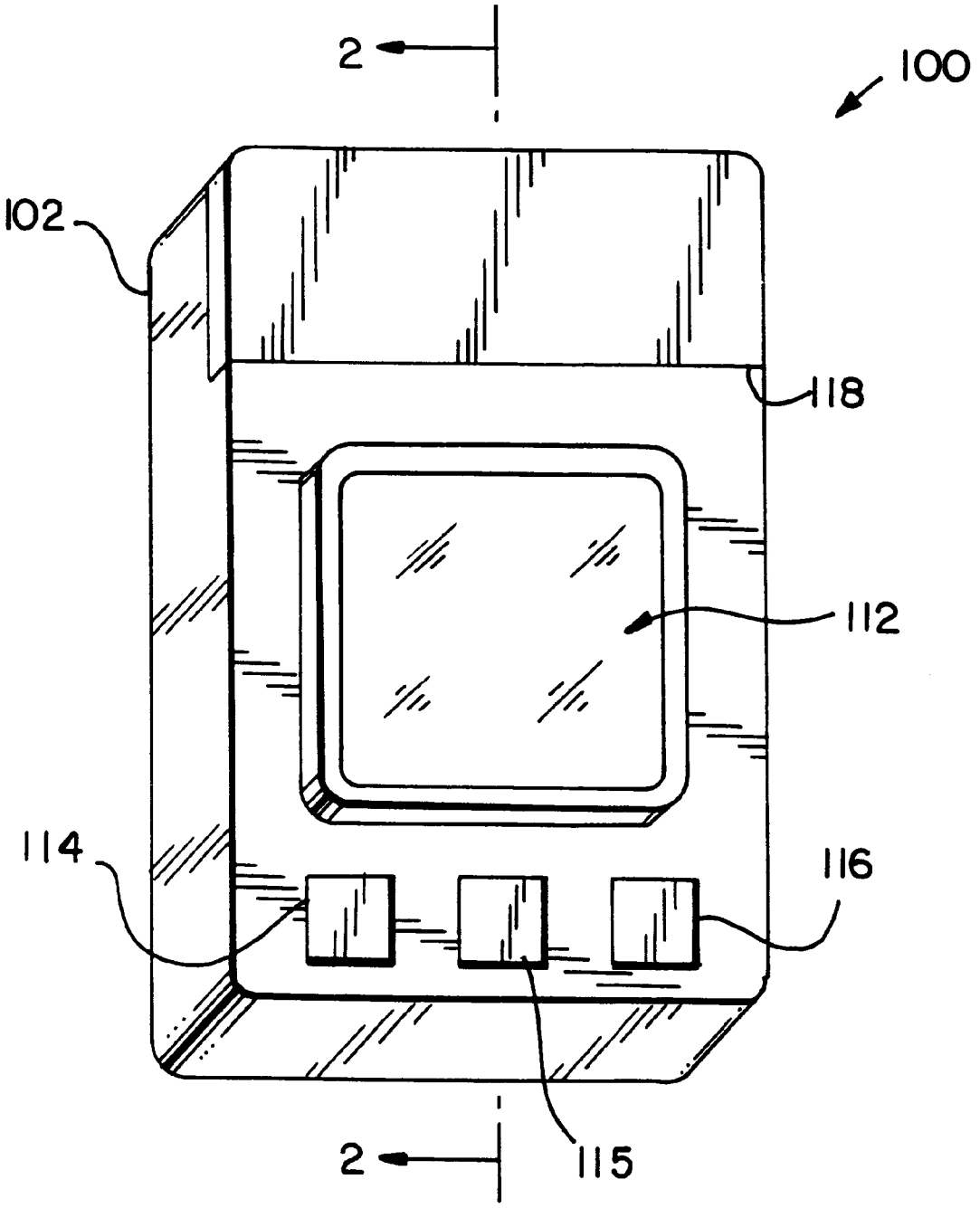
FIG. 1 is an perspective view of an exemplary embodiment of an occupancy sensor according to the present invention.
Figure 2:
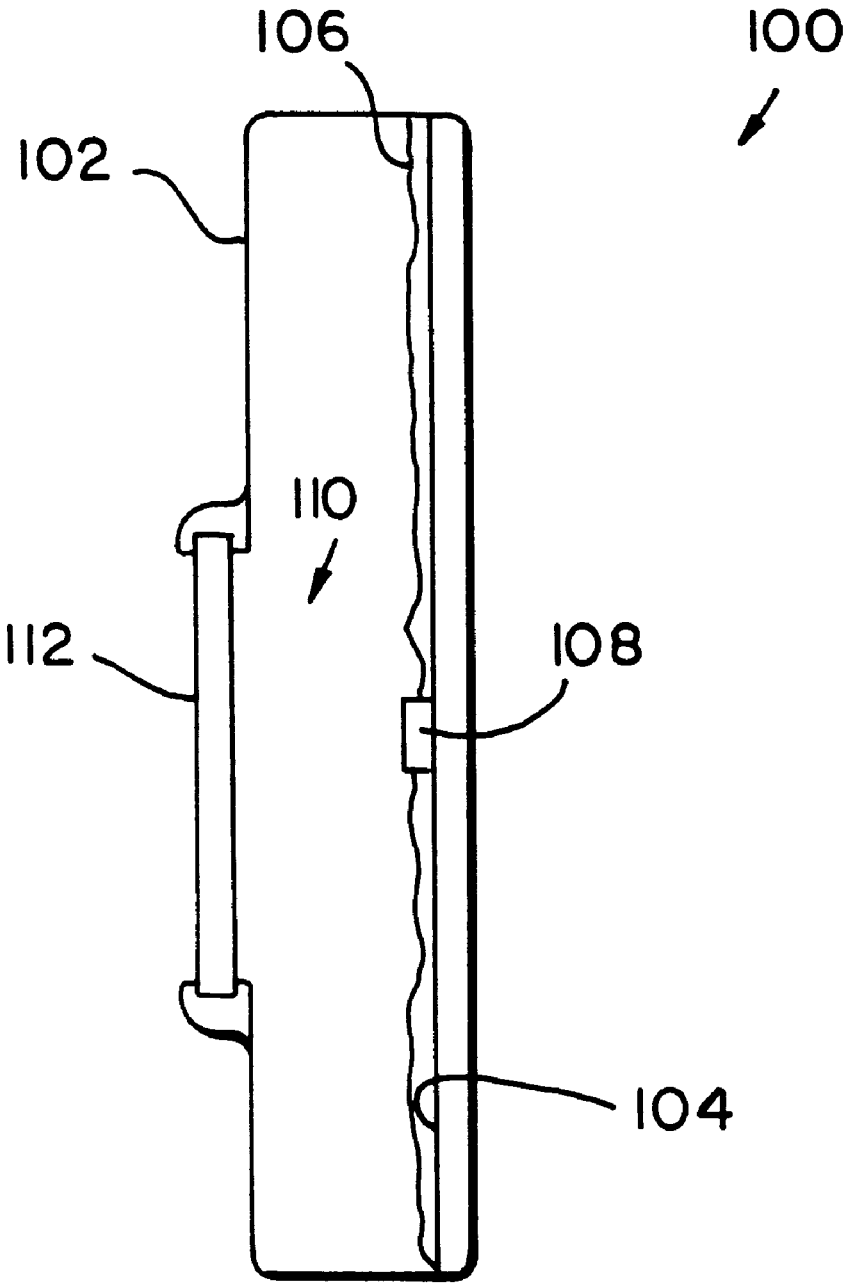
FIG. 2 is a cross-sectional view of the occupancy sensor of FIG. 1 according to the present invention, taken from line 2—2 of FIG. 1.

FIGS. 1 and 2 show an exemplary embodiment of occupancy sensor 100 constructed in accordance with the present invention. Occupancy sensor 100 includes a rigid housing 102, which is preferably fabricated in plastic, disposed about circuit board 104. Circuit board 104 has sensor circuitry 106 mounted thereon. Sensor circuitry 106 includes sensing circuit 108 that generates a detecting beam, which is preferably an infrared detecting beam. Alternatively, sensing circuit 108 can be passive, as described below with respect to the embodiment shown in FIG. 9. Accordingly, phrases such as "generating a detecting beam" are alternatively understood to mean "defining a detection zone." Similarly, phrases such as "detecting beam" are alternatively understood to mean "detection zone." Rigid housing 102 has an open area 110 above sensing circuit 108. Mounted on rigid housing 102 over open area 110 is flat lens 112. Flat lens 112 is preferably a Fresnel lens.

Flat lens 112 provides more efficient longer range sensing within a narrower field of view than conventional curved lenses. Flat lens 112 causes the parallel rays of the detecting beam generated from sensing circuit 108 to diverge less than if they had been passed through a conventional curved lens. This results in less beam distortion, increasing the sensitivity and range of occupancy sensor 100. Thus, flat lens 112 enables occupancy sensor 100 to provide more efficient sensing by focusing the detecting beam into a narrower longer range beam. To provide the longest range, sensing circuit 108 is preferably positioned such that the detecting beam is substantially flat lens 112. Furthermore, because the resulting detecting beam is narrow the area of flat lens 112 can be substantially less than that of a curved lens. This advantageously reduces the cost of occupancy sensor 100.

Occupancy sensor 100 optionally includes manual override switches 114 and 116. When actuated, switch 114 sets sensor 100 in occupancy mode (i.e., sensor 100 outputs a signal indicating occupancy), and switch 116 sets sensor 100 in stand-by mode (i.e., sensor 100 outputs a signal indicating non-occupancy). If both switches are actuated, sensor 100 is preferably set in stand-by mode.

Occupancy sensor 100 preferably includes manual override timer switch 115 that when activated sets sensor 100 in occupancy mode for a predetermined time period. Substantially upon elapse of the predetermined time period, sensor 100 automatically returns to normal operation.

Occupancy sensor 100 also preferably includes access door 118. Access door 118 provides access to adjustment controls (described below with respect to FIGS. 8 and 9) and protects the controls and sensor circuitry 106 from dust and other airborne particles.

Figure 3:
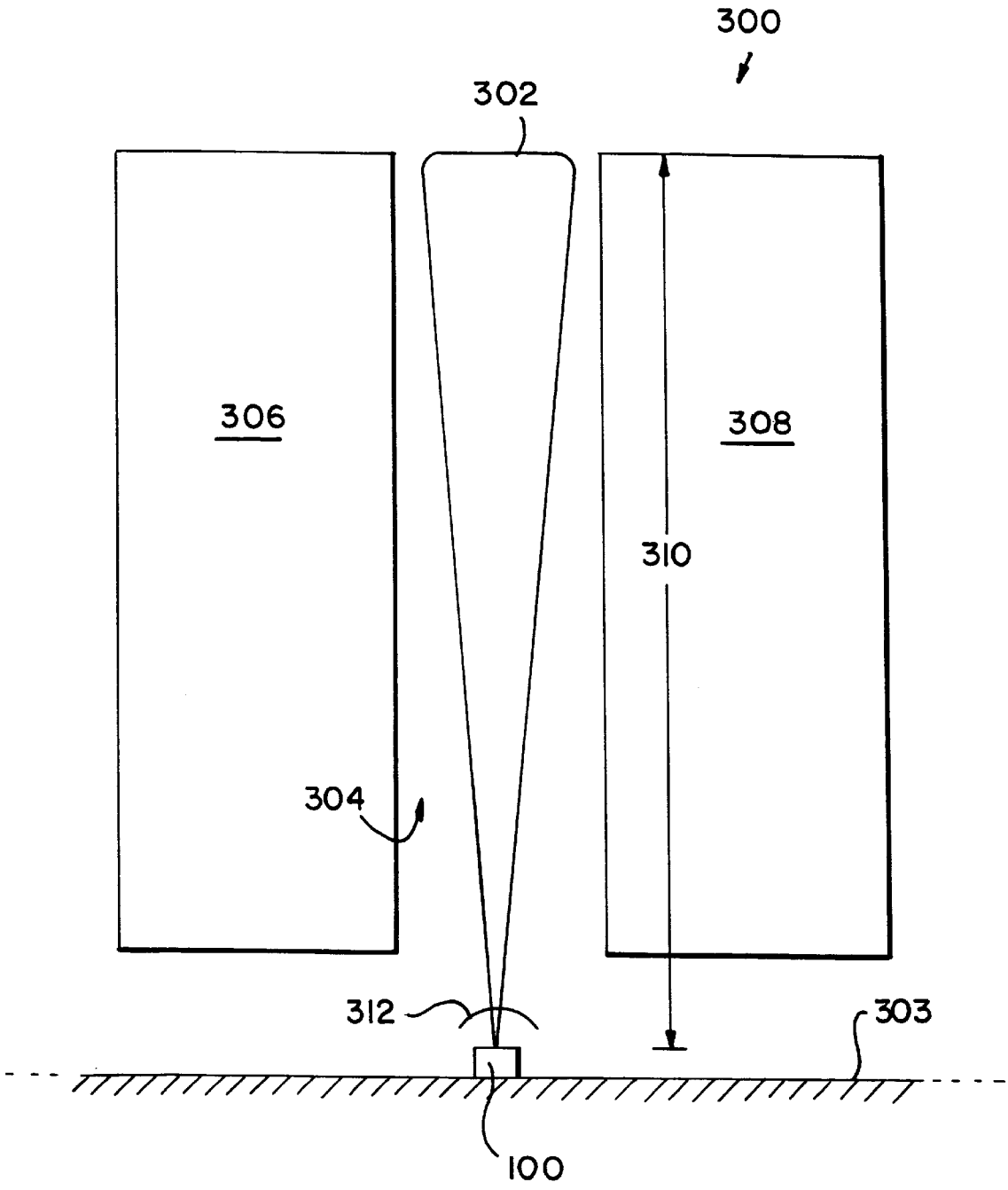
FIG. 3 is a plan view of the field of view of the occupancy sensor of FIG. 1 according to the present invention.

FIG. 3 shows detecting beam 302 of occupancy sensor 100. Occupancy sensor 100 is mounted preferably high on wall 303. Detecting beam 302 is directed down aisle 304 between storage areas 306 and 308. Detecting beam 302 has a maximum range 310 of preferably about 100 feet and a field of view 312 that can range from preferably about 15° to preferably about 25°. Alternatively, ranges less than maximum range 310 can be provided by sensor 100 by positioning sensor 100 such that detecting beam 302 is directed at a point down aisle 304 between sensor 100 and maximum range 310.

Figure 4:
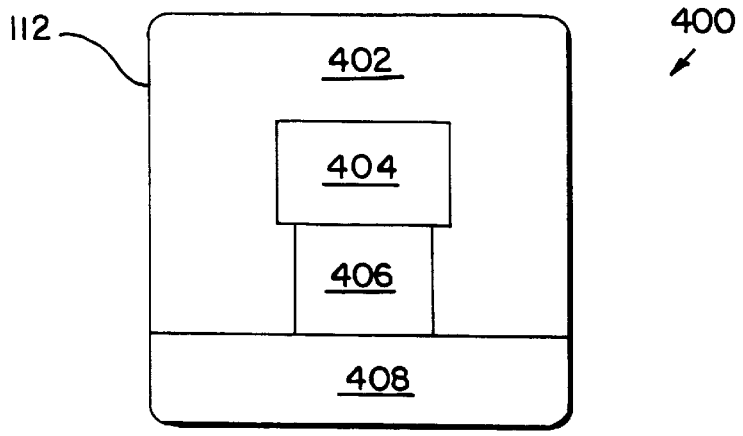
FIG. 4 is a front elevational view of an exemplary embodiment of the flat lens of the occupancy sensor of FIG. 1 according to the present invention.

FIG. 4 shows an exemplary embodiment of flat lens 112 constructed in accordance with the present invention. Flat lens 112 includes lens segments 402, 404, 406, and 408. Lens segment 402 provides occupancy sensor 100 with long-range sensing. Lens segments 404 and 406 provide sensor 100 with two intermediate ranges of sensing, and lens segment 408 provides sensor 100 with short-range sensing. The four ranges of occupancy sensing provided by lens segments 402, 404, 406, and 408 are within field of view 312. Alternatively, other numbers of lens segments and lens segment geometries and configurations can be provided, as is known in the art.

Figure 5:
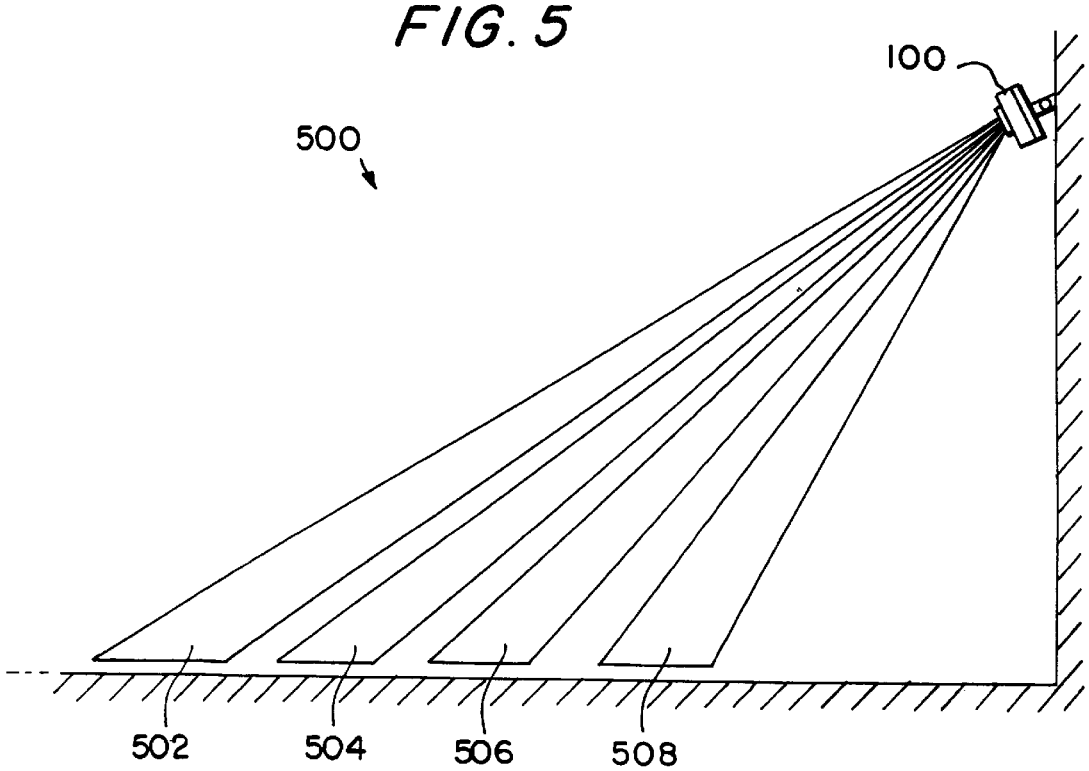
FIG. 5 is a side elevational view of the sensing ranges provided by the flat lens of FIG. 4 according to the present invention.

FIG. 5 shows the projection of detecting beams 502, 504, 506, and 508 resulting respectively from lens segments 402, 404, 406, and 408 of flat lens 112 of FIG. 4.

Figure 6:
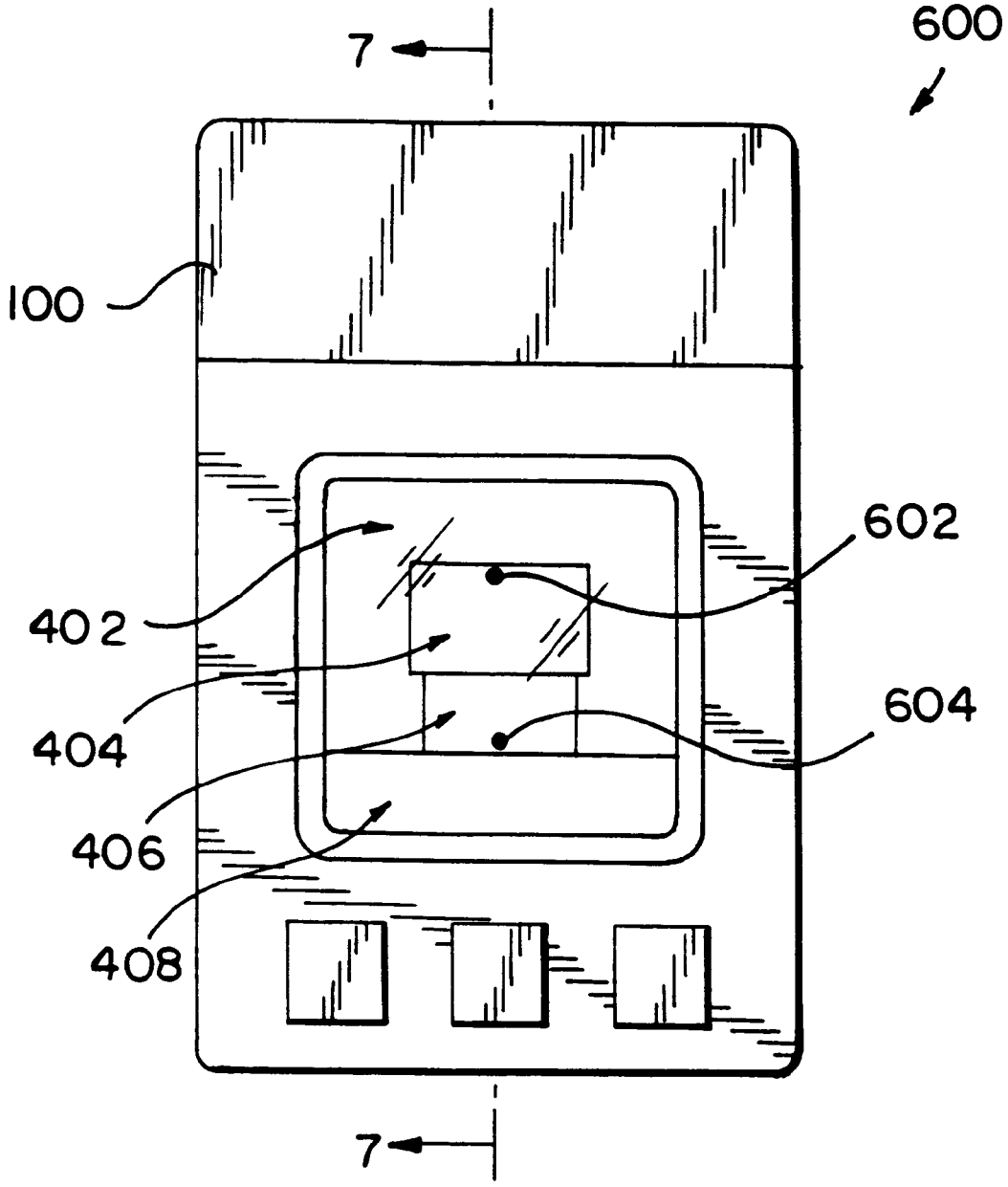
FIG. 6 is a front elevational view of the occupancy sensor of FIG. 1 indicating the positions of LED indicators according to the present invention.
Figure 7:
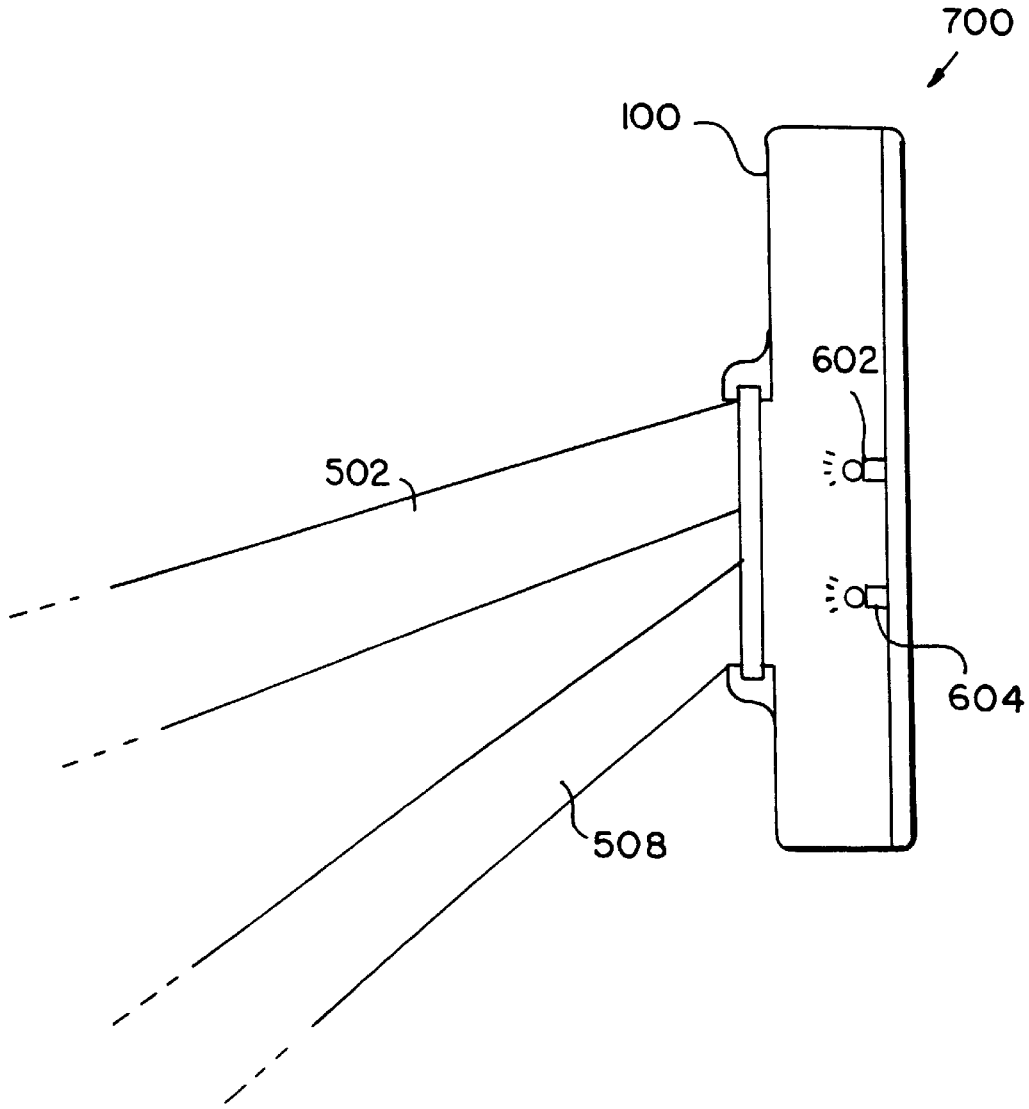
FIG. 7 is a cross-sectional view of the occupancy sensor of FIG. 6 indicating the positions of LED indicators according to the present invention, taken from line 7—7 of FIG. 6.

To facilitate the positioning of occupancy sensor 100, sensor circuitry 106 includes light emitting diodes (LEDs) 602 and 604, as shown in FIGS. 6 and 7. LEDs 602 and 604 illuminate when occupancy is sensed. LED 602 is preferably positioned on circuit board 104 such that it is centered under lens segment 404 at its upper border with lens segment 402. Most of the light rays of LED 602 parallel long-range detecting beam 502 of lens segment 402. LED 602 therefore appears to illuminate more brightly than LED 604 when viewed from within the long-range field of view. Thus by viewing from the area designated for occupancy sensing when LED 602 appears to illuminate more brightly than LED 604, the location of the lower limit of the long-range field of view can be determined. By viewing from the designated area when LED 602 first illuminates, the location of the upper limit of the long-range field of view can be determined. Positional adjustments of sensor 100 can then be made accordingly.

LED 604 is preferably positioned on circuit board 104 such that it is centered under lens segment 406 at its lower border with lens segment 408. Most of the light rays of LED 604 parallel short-range detecting beam 508 of lens segment 408. LED 604 therefore appears to illuminate more brightly than LED 602 when viewed from within the short-range field of view. Thus, by viewing from the designated area when LED 604 appears to illuminate more brightly than LED 602, the location of the upper limit of the short-range field of view can be determined. By viewing from the designated area when LED 604 first illuminates, the location of the lower limit of the short-range field of view can be determined. Positional adjustments of sensor 100 can then be made accordingly.

When occupancy sensor 100 is viewed from within the fields of view of intermediate-range detecting beams 504 and 506, neither LED 602 nor LED 604 appears to illuminate more brightly than the other.

Alternatively, other types of indicators can be used with occupancy sensor 100 to indicate when occupancy is sensed within the various sensing ranges of field of view 312. For example, sound transmitting devices that transmit different sound signals to a receiver can be used to indicate the upper and lower limits of the various ranges.

Figure 8:
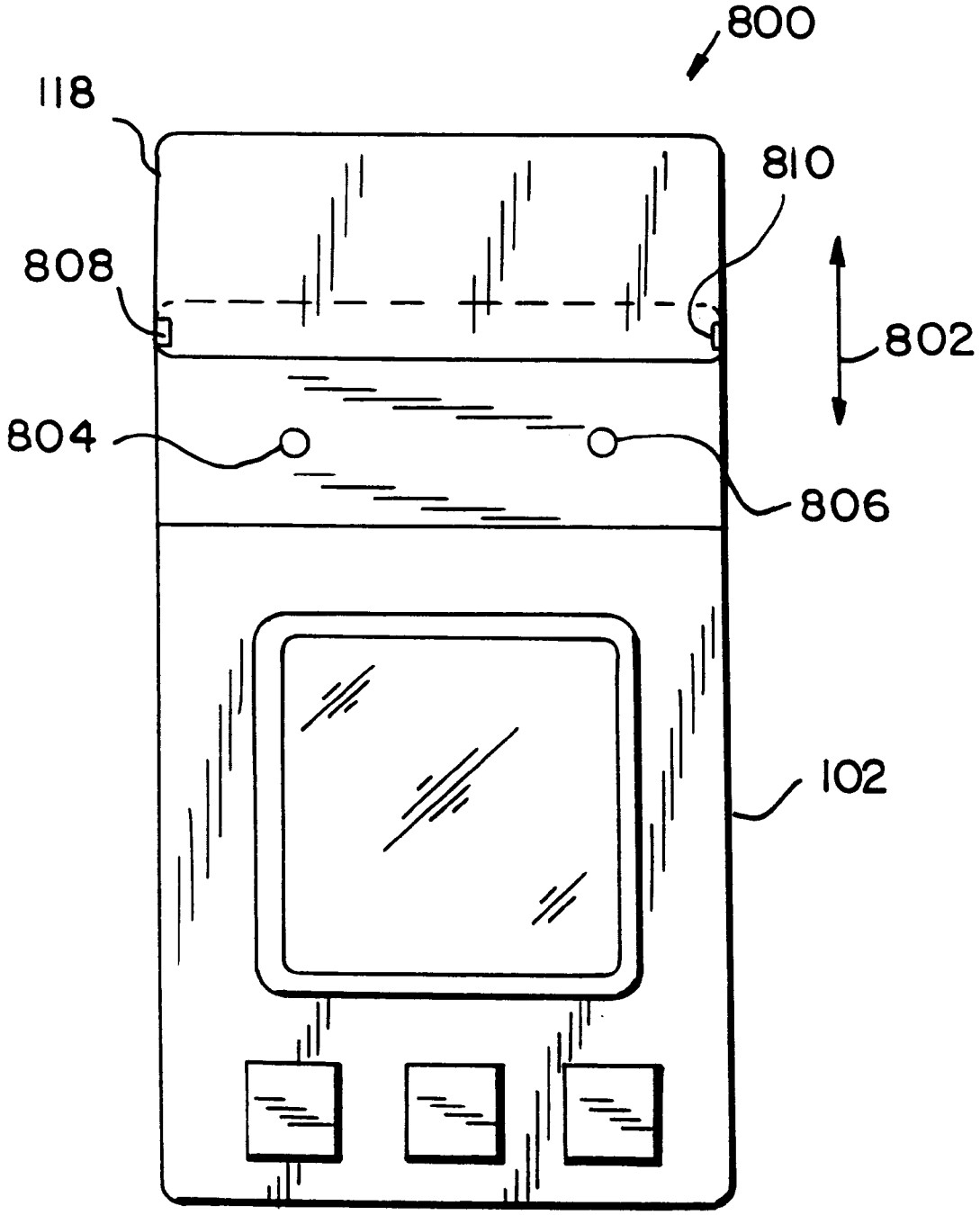
FIG. 8 is a front elevational view of an exemplary embodiment of an access door of the occupancy sensor of FIG. 1 according to the present invention.

FIG. 8 shows an exemplary embodiment of access door 118 constructed in accordance with the present invention. Access door 118 is preferably a sliding door that slides in the directions of arrow 802. Access door 118 permits access to adjustment controls 804 and 806 when open (as shown in FIG. 8) and protects adjustment controls 804 and 806 and sensor circuitry 106 from airborne particles when closed. Access door 118 preferably remains attached to rigid housing 102 preferably with tabs 808 and 810. Tabs 808 and 810 slide along the inside edges of rigid housing 102 in preferably integrally molded tracks that stop tabs 808 and 810 when access door 118 is fully open. This prevents the loss of access door 118 when sensor adjustments are being made, particularly when occupancy sensor 100 is located high on a wall or on a ceiling where retrieval of an accidentally dropped access door is unlikely. Alternatively, other known techniques can be used to retain sliding door 118 to rigid housing 102. Moreover, access door 118 alternatively can be other types of doors, such as, for example, a hinged door that preferably remains in an open position while adjustments are being made.

Figure 9:
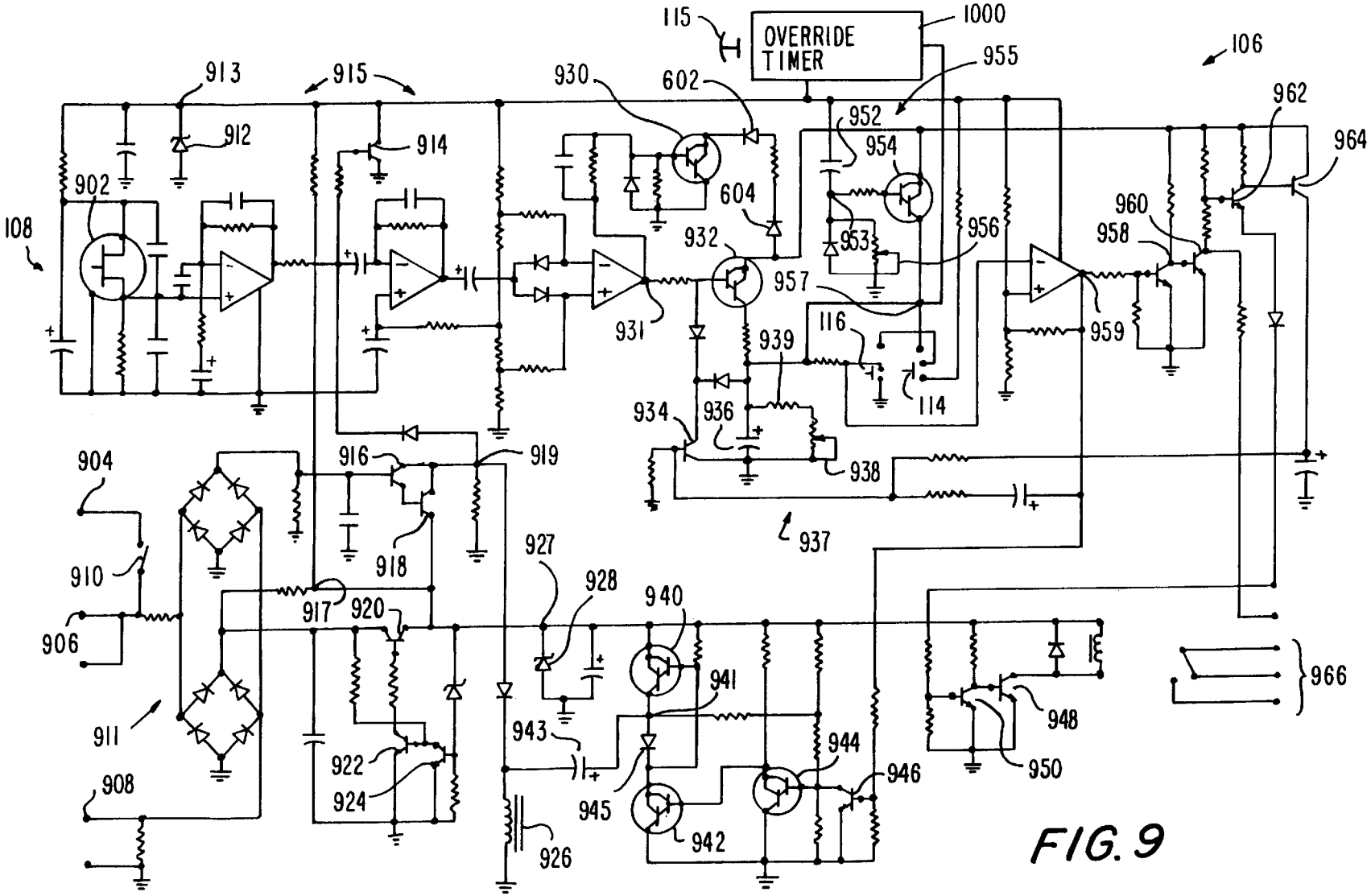
FIG. 9 is a circuit diagram of an exemplary embodiment of the sensor circuitry of the occupancy sensor of FIG. 1 according to the present invention.

FIG. 9 shows an exemplary embodiment of sensor circuitry 106 constructed in accordance with the present invention. Sensor circuitry 106 includes sensing circuit 108, which is preferably a passive infrared detecting circuit that preferably includes piezoelectric chip 902. Detected changes in temperature are focused by flat lens 112 on chip 902, which generates a small voltage in response. The small voltage is then processed through sensor circuitry 106 to generate an occupancy signal indicating occupancy.

Sensor circuitry 106 also includes input voltage terminal 906 for coupling to an input voltage, ground terminal 908 for coupling to ground or neutral, and output terminal 904 for providing occupancy signals to one or more electrical appliances, such as, for example, high intensity discharge (HID) lighting. Output terminal 904 is preferably a relay contact whose output signal is determined by the position of switch 910 (e.g., open position indicates non occupancy, while closed position indicates occupancy). The position of switch 910 is controlled by relay coil 926, which responds accordingly when sensor circuitry 106 goes from stand-by mode to occupancy mode and vice versa. Optionally, sensor circuitry 106 includes auxiliary output relay contacts 966.

Voltage regulation circuit 911 provides two internal voltages. The first internal voltage is preferably about 6.8 volts set by Zener diode 912 at node 913, and the second internal voltage is preferably about 30 volts set by Zener diode 928 at node 927.

Sensor circuitry 106 further includes NPN Darlington pairs 930, 932, 940, 942, 944, and 954; NPN transistors 914, 922, 924, 934, 946, 948, 950, 958, and 960; PNP transistors 916, 918, 920, 962, and 964; manually actuated switches 114, 115, and 116; and LEDs 602 and 604. All capacitors are preferably in the microfarad range.

Sensor circuitry 106 includes delay timer circuit 937, which includes capacitor 936 and potentiometer 938. When occupancy is sensed, capacitor 936 charges up. When occupancy is no longer sensed, sensor circuitry 106 continues to output a signal indicating occupancy until capacitor 936 discharges through resistor 939 and potentiometer 938. This delay time prevents lighting or other electrical appliances from abruptly turning off when a person momentarily leaves the sensor's field of view. The time delay can preferably be adjusted from about 15 seconds to about 30 minutes by varying potentiometer 938 via adjustment control 804.

Sensor circuitry 106 preferably includes warm-up timer circuit 955, which sets occupancy sensor 100 in occupancy mode for a predetermined warm-up period when power is first applied to sensor 100. Sensor 100 is thus well-suited for HID lighting, provided that both are coupled to the same input voltage source, because HID lamps require a warm-up period at high intensity when first powered-up.

Warm-up timer circuit 955 includes capacitor 952 and potentiometer 956. When input voltage is first applied to sensor circuitry 106, node 913 quickly rises to about 6.8 volts DC. Capacitor 952, which is initially discharged, first acts like a short circuit, permitting Darlington pair 954 to turn ON. This provides an activating signal (i.e., a logical "1" signal) at node 957, which causes sensor 100 to output a signal indicating occupancy regardless of whether occupancy is actually sensed. Until capacitor 952 charges up, sensor circuitry 106 continues to output a signal indicating occupancy. Once capacitor 952 is charged up, it acts like an open circuit, causing voltage at node 953 to go low, turning OFF Darlington pair 954. This returns sensor circuitry 106 to normal operation. When sensor 100 powers-down, capacitor 952 discharges through NPN transistor 914.

The warm-up period is thus substantially the charge-up time of capacitor 952, which is determined by the values of capacitor 952 and potentiometer 956. Accordingly, the warm-up time can be adjusted by varying potentiometer 956 via adjustment control 806, and preferably ranges from about 15 to 30 minutes.

Sensor circuitry 106 preferably also includes override timer circuit 1000. Override timer circuit 1000 sets occupancy sensor 100 in occupancy mode for a predetermined time period when activated by switch 115. The predetermined time period can be adjusted up to several hundred hours. Occupancy sensor 100 is again well-suited for HID lighting, because HID lamps require a burn-in period of about 100 to 200 hours at high intensity when first installed.

Override timer circuit 1000 is coupled to node 913 to receive input voltage. The output of override timer circuit 1000 is coupled to node 957. When activated by switch 115, override timer circuit 1000 outputs a logical "1" signal causing sensor 100 to output a signal indicating occupancy regardless of whether occupancy is actually sensed. Override timer 1000 can be other known circuits that when activated output a logical "1" signal for an adjustable time period of up to several hundred hours.

Figure 10:
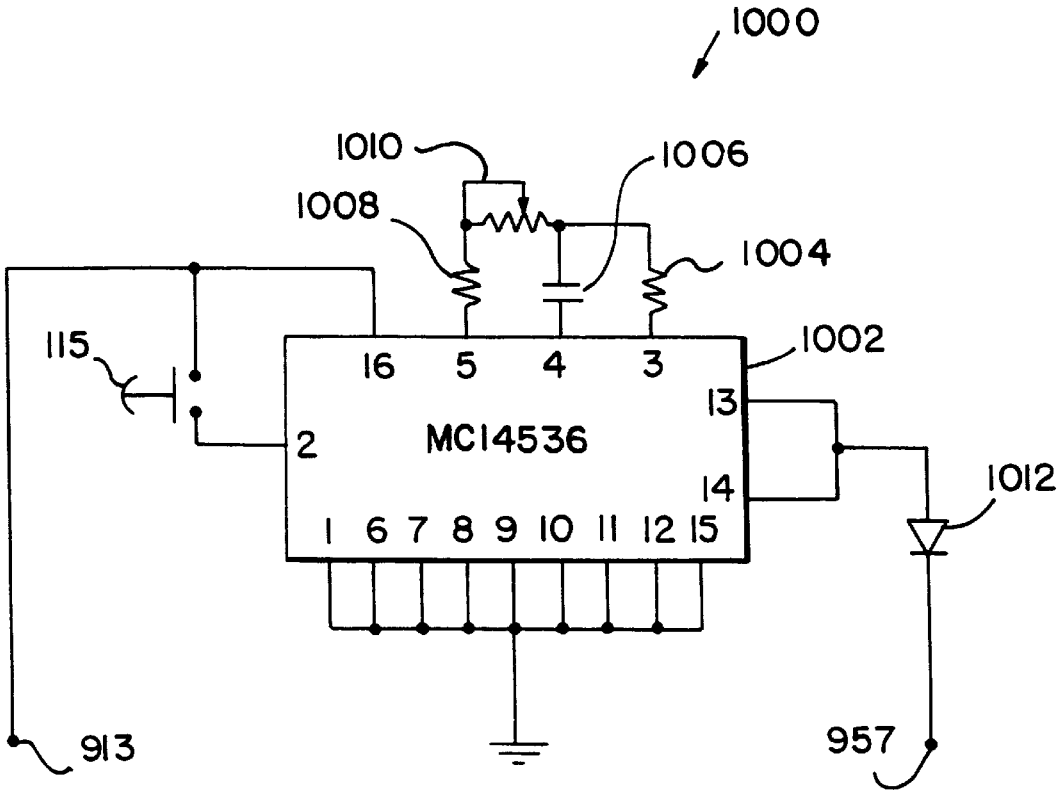
FIG. 10 is a circuit diagram of an exemplary embodiment of the override timer circuit of the sensor circuitry of FIG. 9 according to the present invention.

FIG. 10 shows an exemplary embodiment of override timer circuit 1000 constructed in accordance with the present invention. Override timer circuit 1000 includes timer chip 1002, which can be an MC14536 programmable timer chip, manufactured by Motorola, Inc, of Austin, Tex. Pin connections for timer chip 1002 are as shown in FIG. 10. Override timer circuit 1000 also includes resistors 1004 and 1008, capacitor 1006, diode 1012, and potentiometer 1010. Potentiometer 1010 is preset such that the resultant oscillator frequency preferably is about 23.3 Hz. At that frequency, timer chip 1002 outputs a logical "1" signal for about 100 hours, after which the output signal goes low, returning occupancy sensor 100 to normal operation.

Figure 11:
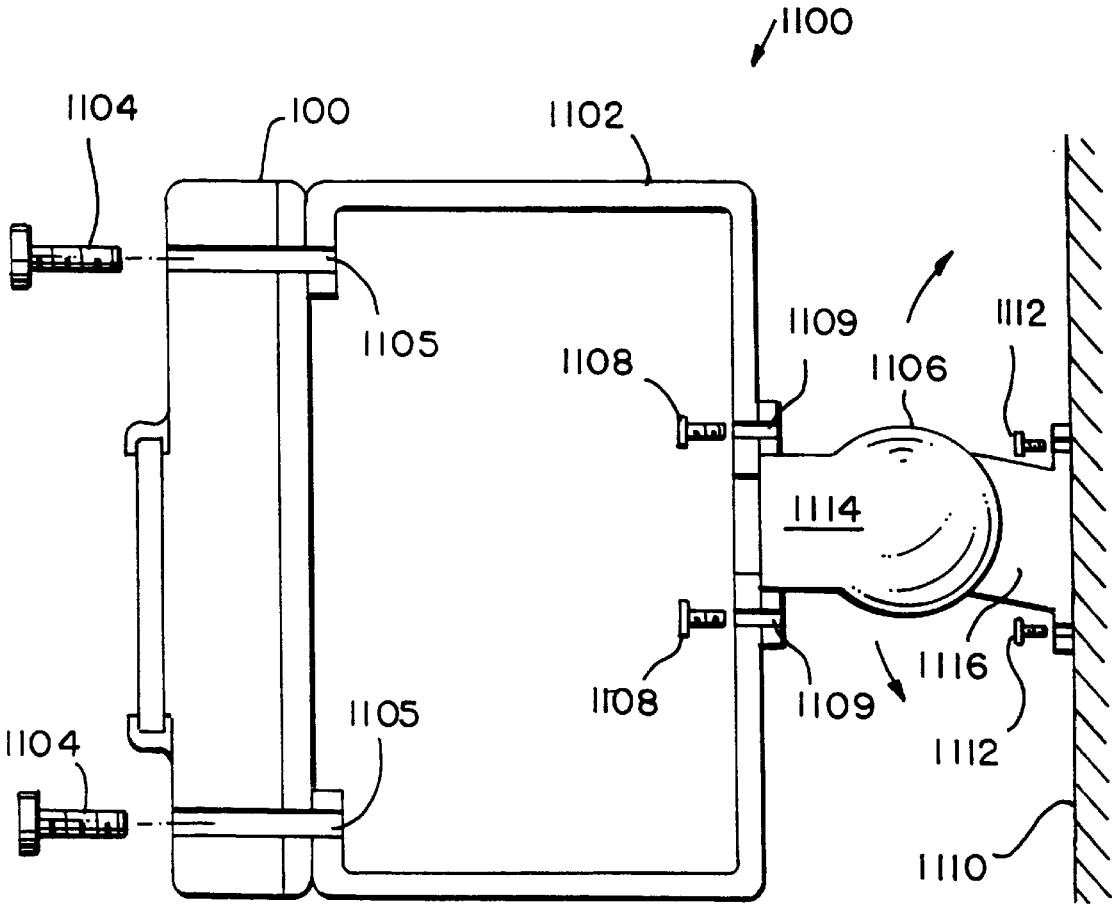
FIG. 11 is a side elevational view of an occupancy sensor system according to the present invention.

FIG. 11 shows an exemplary embodiment of occupancy sensor system 1100 constructed in accordance with the present invention. System 1100 includes occupancy sensor 100 mounted to electrical enclosure 1102 with mounting screws 1104 through threaded holes 1105. Electrical enclosure 1102 fastens to electrical connector 1106 with mounting screws 1108 and threaded holes 1109. Note that any other suitable manner of fastening sensor 100 to enclosure 1102 and of fastening enclosure 1102 to connector 1106 can be used. Further note that enclosure 1102 and connector 1106 can be integrally constructed (e.g., stamped or welded) to form a single unit.

The assembly of sensor 100, enclosure 1102, and connector 1106 (i.e., occupancy sensor system 1100) can be mounted with mounting screws 1112 to structure 1110, which may be a wall, ceiling, support beam, or any other structure capable of supporting system 1100. Note that system 1100 can be mounted in any other suitable manner.

Electrical connector 1106 is preferably hollow to permit electrical wiring (not shown) to pass through from structure 1110 to electrical enclosure 1102. Electrical connections to sensor 100 can accordingly be made in enclosure 1102. Preferably, connector 1106 includes rotatable portion 1114 that rotates about fixed portion 1116. This permits occupancy sensor 100 to be angled horizontally and vertically with respect to structure 1110, thus permitting final sensing alignments of sensor 100 to be made.

Alternatively, occupancy sensor system 1100 can include occupancy sensor 100 fastened to any known swivel type bracket or other similar mounting hardware that permits sensor 100 to be angled horizontally and vertically with respect to structure 1110.

Thus it is seen that occupancy sensors providing long-range occupancy sensing within a narrow field of view are provided. One skilled in the art will appreciate that the present invention can be practiced by other than the described embodiments, which are presented for purposes of illustration and not of limitation, and the present invention is limited only by the claims which follow.

What is claimed is:

1. An occupancy sensor for long-range sensing within a narrow field of view, said occupancy sensor comprising:

sensor circuitry operable to sense occupancy and generate occupancy signals, said sensor circuitry comprising a passive infrared sensing circuit that defines a detection zone;

a voltage input terminal coupled to said sensor circuitry for receiving an input voltage;

an output terminal coupled to said sensor circuitry for outputting said occupancy signals;

a rigid housing disposed about said sensor circuitry, said rigid housing having an opening over said sensing circuit; and a flat lens mounted on said rigid housing over said opening, said sensing circuit positioned such that said detection zone is substantially perpendicular in plan view to said flat lens.

2. The occupancy sensor of claim 1 wherein said occupancy sensor provides long-range sensing up to about 100 feet within a field of view ranging from about 15° to about 25°.

3. The occupancy sensor of claim 1 wherein said flat lens is a Fresnel lens.

4. The occupancy sensor of claim 1 wherein said output terminal comprises a relay contact.

5. The occupancy sensor of claim 1 wherein said flat lens has a plurality of lens segments that enable said flat lens to provide said occupancy sensor with long, intermediate, and short range occupancy sensing, said sensing circuit being positioned substantially perpendicular to a long-range lens segment.

6. The occupancy sensor of claim 5 wherein said sensor circuitry further comprises a plurality of indicators that indicate when occupancy is sensed to facilitate positioning of said occupancy sensor, one said indicator indicating when long-range occupancy is sensed and another said indicator indicating when short-range occupancy is sensed.

7. The occupancy sensor of claim 6 wherein said indicators comprise light emitting diodes that illuminate and are visible through said flat lens when occupancy is sensed, one said light emitting diode appearing to illuminate more brightly than other said light emitting diodes when viewed from within a long-range field of view, and another said light emitting diode appearing to illuminate more brightly than other said light emitting diodes when viewed from within a short-range field of view.

8. The occupancy sensor of claim 1 wherein said sensor circuitry further comprises an override timer circuit that when activated causes said sensor circuitry to output for a predetermined time period an occupancy signal indicating occupancy, said override timer circuit returning said occupancy sensor to normal operation substantially upon elapse of said predetermined time period, said override timer circuit comprising resistive and capacitive components that determine a duration of said predetermined time period.

9. The occupancy sensor of claim 8 wherein said resistive component comprises an adjustable potentiometer allowing said duration of said predetermined time period to be varied.

10. The occupancy sensor of claim 8 wherein said duration of said predetermined time period is at least about 100 hours.

11. The occupancy sensor of claim 1 wherein said sensor circuitry further comprises a warm-up timer circuit, said warm-up timer circuit causing said sensor circuitry to output an occupancy signal indicating occupancy for a predetermined warm-up period when power is initially applied to said occupancy sensor, said warm-up timer circuit returning said occupancy sensor to normal operation substantially upon elapse of said predetermined warm-up period, said warm-up timer circuit comprising resistive and capacitive components that determine a duration of said predetermined warm-up period.

12. The occupancy sensor of claim 11 wherein said resistive component comprises an adjustable potentiometer allowing said duration of said predetermined warm-up period to be varied.

13. The occupancy sensor of claim 1 wherein said rigid housing comprises an access door, said access door permitting access to occupancy sensor adjustment controls when open and protecting said adjustment controls and said sensor circuitry from airborne particles when closed, said access door remaining attached to said rigid housing to prevent loss of said access door.

14. The occupancy sensor of claim 1 further comprising mounting hardware attached to said occupancy sensor, said hardware permitting said occupancy sensor to be positioned after said hardware is mounted to a structure such that said long-range sensing and said field of view can be aligned in accordance with a designated area.

15. An occupancy sensor for long-range sensing within a narrow field of view, said occupancy sensor comprising:

sensor circuitry operable to sense occupancy and generate occupancy signals, said sensor circuitry comprising a sensing circuit that generates a detecting beam;

a voltage input terminal coupled to said sensor circuitry for receiving an input voltage;

an output terminal coupled to said sensor circuitry for outputting said occupancy signals;

a rigid housing disposed about said sensor circuitry, said rigid housing having an opening over said sensing circuit; and a flat lens mounted on said rigid housing over said opening, said sensing circuit positioned such that said detecting beam is substantially perpendicular to said flat lens.

16. The occupancy sensor of claim 15 further comprising mounting hardware attached to said occupancy sensor, said hardware permitting said occupancy sensor to be positioned after said hardware is mounted to a structure such that said long-range sensing and said field of view can be aligned in accordance with a designated area.

17. A method of long-range occupancy sensing within a narrow field of view, said method comprising:

defining long, intermediate, and short range detection zones through a flat lens with a sensing circuit of an occupancy sensor, said flat lens comprising a plurality of lens segments that provide said occupancy sensor with long, intermediate, and short range occupancy sensing; and positioning said sensing circuit such that said detection zones are substantially perpendicular in plan view to said flat lens.

18. The method of claim 17 further comprising:

indicating when occupancy is sensed in said long range; and indicating when occupancy is sensed in said short range.

19. The method of claim 17 further comprising outputting an occupancy signal indicating occupancy for a predetermined time period.

20. The method of claim 19 further comprising returning said occupancy sensor to normal operation substantially upon elapse of said predetermined time period.

21. The method of claim 19 further comprising adjusting said predetermined time period.

22. The method of claim 17 further comprising outputting an occupancy signal indicating occupancy for a predetermined warm-up period when power is initially applied to said occupancy sensor.

23. The method of claim 22 further comprising returning said occupancy sensor to normal operation substantially upon elapse of said predetermined warm-up period.

24. The method of claim 22 further comprising adjusting said predetermined warm-up period.

* * * * *